United States Patent [19]

Baker et al.

[11] 3,933,193

[45] Jan. 20, 1976

[54] APPARATUS FOR CONTINUOUS CASTING OF METAL STRIP BETWEEN MOVING BELTS

[75] Inventors: William Albert Baker, Mexico, N.Y.; Eric Arthur Wootton; Sidney Reginald King, both of Banbury, England; Donald Louis William Collins, Daventry, England; George Edward Macey, Banbury, England

[73] Assignee: Alcan Research and Development Limited, Montreal, Canada

[22] Filed: June 27, 1974

[21] Appl. No.: 483,836

Related U.S. Application Data

[63] Continuation-in-part of Ser. No. 426,046, Dec. 19, 1973, abandoned, which is a continuation of Ser. No. 225,979, Feb. 14, 1972, abandoned.

[30] Foreign Application Priority Data

Feb. 16, 1971 United Kingdom ..... 4780/71
Feb. 3, 1972 United Kingdom ..... 5187/72

[52] U.S. Cl. ..... 164/146; 164/278; 164/283 MT
[51] Int. Cl.[2] ..... B22D 11/06
[58] Field of Search ..... 164/49, 87, 146, 250, 278, 164/283 MT

[56] References Cited

UNITED STATES PATENTS

| | | | |
|---|---|---|---|
| 2,640,235 | 6/1953 | Hazelett | 164/87 |
| 2,778,077 | 1/1957 | Andrews | 164/49 |
| 2,978,761 | 4/1961 | Foye et al. | 164/278 |
| 3,041,686 | 7/1962 | Hazelett et al. | 164/87 |
| 3,110,941 | 11/1963 | Fagg | 164/278 |
| 3,426,836 | 2/1969 | Altenpohl et al. | 164/278 |
| 3,482,620 | 12/1969 | Dumont-Fillon | 164/278 |

FOREIGN PATENTS OR APPLICATIONS

| | | | |
|---|---|---|---|
| 104,675 | 7/1938 | Australia | 164/87 |
| 1,498,360 | 9/1967 | France | 164/278 |

*Primary Examiner*—R. Spencer Annear
*Attorney, Agent, or Firm*—Cooper, Dunham, Clark, Griffin & Moran

[57] ABSTRACT

In the casting of aluminium and other metals having a relatively low melting point, the metal is cast between a pair of belts, which are caused to move along precisely defined paths by means of externally applied attractive forces, which hold the outer surface of at least the upper of the belts against closely spaced support surfaces. The attractive force is preferably achieved by sub-atmospheric pressure conditions on the reverse side of the belts, although magnetic forces may be employed for the same purpose. The belts are preferably arranged to provide a casting cavity of decreasing thickness to maintain close contact between the belt and the solidifying metal to secure rapid transfer of heat from the metal to the belts throughout the length of the casting zone. The cooling of the belts is preferably achieved by directing jets of coolant substantially normally to the belt at closely spaced localities.

25 Claims, 10 Drawing Figures

APPARATUS FOR CONTINUOUS CASTING OF METAL STRIP BETWEEN MOVING BELTS

CROSS REFERENCE TO RELATED APPLICATIONS

Figure 1:
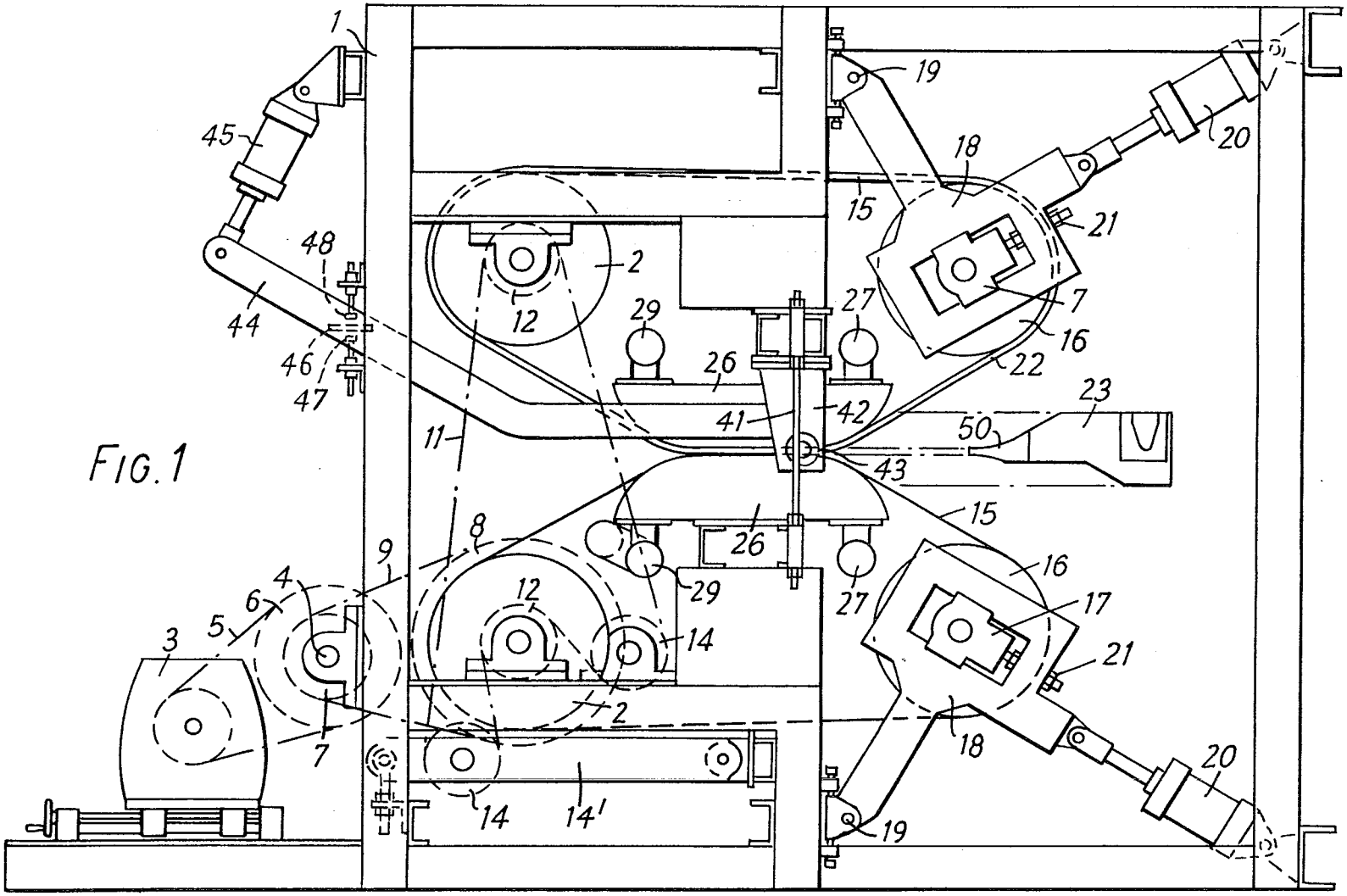

This application is a continuation-in-part of our copending application Ser. No. 426,046 filed Dec. 19, 1973, and now abandoned which had been copending with and was a continuation of our application Ser. No. 225,979, filed Feb. 14, 1972, and now abandoned.

The present invention relates to continuous casting of metals in the form of strip and in particular it relates to methods and apparatus for casting metals, such as aluminium (including aluminium alloys) and zinc and other metals which melt at a similar or lower temperature, between a pair of moving surfaces, which are constituted by flexible metallic bands or belts.

It has long been apparent that significant economies should be attainable in the production of aluminium strip and sheet if wide thin slab for hot rolling or wide thick strip for cold rolling, could be cast at high rates, and hence at low cost, and with the high surface and sub-surface quality necessary to provide the final rolled product quality when the as cast stock is rolled without surface treatment for removal of casting defects.

In operation, existing casting apparatus employing a pair of spaced flexible metallic bands to define a casting zone or mould space do not satisfy these requirements. Although existing apparatus may be operated to give high production rates, the cast stock tends to be of uneven thickness and to have surface imperfections caused by surface exudates of material differing markedly in composition, and hence in properties, from material of the average composition of the cast stock. This is accompanied by sub-surface variations of metallurgical structure which are likewise a source of variation of properties. These surface exudates and sub-surface defects arise from variations of freezing rate between one part of the cast slab or strip surface with respect to other parts. Such variations are believed to arise from the development of gaps between parts of the cooling surface of the casting and the adjacent area of the moving belt surface. Into these gaps, between the belts and the consequently uncooled adjacent casting surface, low melting liquid can exude to form the above mentioned surface exudates. The present invention eliminates these surface and sub-surface defects by a means which also provides a solution to the problem of inconsistency of cross-sectional shape of the cast stock for satisfactory strip shape control in subsequent rolling operations.

It is the principal object of the present invention to provide an apparatus for the continuous casting of metal, such as aluminium, in which the belts move on a precisely controlled path, which is arranged so that the metal cast in the mould space remains in close contact with the belt during the casting operation so that heat may be removed through the belt in a uniform manner and so that any gaps developed between the belt and the freezing strip are so small as to have no adverse effects on the surface or sub-surface quality of the cast strip or slab.

Many constructions of apparatus have been put forward in which a pair of moving, water-cooled parallel belts are employed for the purpose of defining a mould space, the narrower side edges of which are closed by edge dams. Whilst in the practical application of such apparatus it has been found preferable to employ flexible or articulated side dams which move with the belts, in some early forms of such apparatus a stationary, water-cooled edge dam was employed so that the metal at the sides of the mould space solidified more rapidly than the metal at the middle with the result that the emerging strip tended to be thicker at the edges than at the middle.

To counteract that difficulty it was proposed in U.S. Pat. No. 2,640,235, in an apparatus primarily designed for casting steel, to produce an outward bowing of one or both of the upper and lower belts in the zone in which molten metal is poured. The distance apart of the belts at the middle of the space is thereafter progressively decreased while the spacing at the edge of the belts is maintained constant. The use of magnetic force to act on the belts during part of their travel through the zone in which they form the boundaries of the mould space was proposed, but this was in conjunction with exceptionally heavy tension in the belts required to cause the bowing of the belts at the critical portion of the casting zone and in fact the effect of such magnets in controlling the path of the belts could only be minimal since the belts are indicated as being spaced from the magnets by non-magnetic spacers of such dimensions as to leave the requisite water passages between the magnet and the belt and it is found experimentally that no substantial magnetic force can be obtained in that way. Moreover, since the centre of the belts is less heavily tensioned than the edges it is to be expected that the center of the belt would sag away from the spacers. Since the object of that apparatus was primarily to obtain strip of more uniform gauge than previously without imposing pressure on it between the bands, such sagging might be of little importance. By contrast with U.S. Patent No. 2,640,235 the apparatus of the present invention relies on guiding the casting belts in very closely defined paths so as to ensure that at any position in the casting zone the rate of heat removal is substantially equal across the full width of the casting zone and that the longitudinal taper (if any) is substantially constant at all positions across the width to ensure rapid removal of heat at all positions in the casting zone and thus to avoid the formation of exudates.

In its broadest aspect the present invention provides an apparatus for the continuous casting of metal in strip form in which molten metal is poured into a mould space defined by a pair of movable bands or belts, the path of which is controlled by applying forces in a direction perpendicular to the path of the band or belt to maintain it in contact with mould cavity-defining supports at closely spaced positions and precisely machined so as to be in a common plane in the casting zone. Such forces may be effected in various ways. Where the band or belt is of ferromagnetic material (as it almost invariably is) the force can be produced by magnetic attraction between the band or belt and a series of closely spaced pole pieces, which also comprise the precision machined supports for defining the mould cavity. Alternatively the force can be produced by establishing a differential pressure between the opposite faces of the belt, which may readily be achieved by drawing cooling water through the space behind the belt by means of a suction pump at the outlet end of the space. This is our preferred method of applying our invention and of the several possible ways of achieving this differential pressure, while at the same time cooling the belt or band efficiently and uniformly, we prefer the jet cooling system operating at sub-atmospheric pressure which is described later, since by that means particularly rapid and uniform extraction of heat from the belt may be obtained and thus the temperature rise in the belt and the temperature variation across the belt width are minimised. In consequence the risk of thermal distortion of the belt is minimised. Even with uniform heat extraction across the width, the temperature gradient through the belt produces a thermal stress tending to buckle the belt, but with our very efficient cooling system this stress is held to low levels and is easily counteracted by a relatively small differential pressure.

Since the alloys which it is desired to cast continuously by the present method contract by several percent during solification, it is highly desirable to provide means for reducing progressively the space between the two opposed faces of the mould space so as to maintain any space between the belts and the surfaces of the strip at a very low value whilst the metal is passing through the zone in which solidification takes place. The use of fixed magnetic pole pieces or belt supports against which the belt is held by differential pressure, permits any desired profile to be applied very simply to the mould space. In shaping the unit, of which the pole pieces or belt supports form part, the mould space may be arranged so as to close progressively in the zone in which the metal undergoes solidification. The amount by which the mould faces must progressively approach each other will vary with the thickness of the strip and in the case of the thinnest strip the variation may be no more than a few thousandths of an inch. It is possible to provide rotatable elements which control the profile of a moving belt to this order of accuracy and such devices are within the scope of the invention but in the preferred form of apparatus the belt is made to slide over suitable machined stationary pole pieces or belt supports, because these can be made and maintained to closer dimensional tolerances than rotatable elements. With either type the belt is made to conform closely with its profiled backing by magnetic attraction or by differential pressure, created, for example, by sucking cooling water through water cooling spaces of which the belt back surface constitutes one boundary so that the sub-atmospheric pressure behind the belt provides the force required to pull the belt into intimate contact with its accurately machined support.

The heat transfer from the cast slab or strip to the cooling water via an interposed metal band or belt is characterised by a very large temperature drop at the metal/belt interface, a modest temperature drop through the metal band or belt, and another modest but larger temperature drop at the belt/water interface. The mean temperature of the metal band or belt is thus higher than that of the water coolant and it is desirable to minimise this difference in temperature between the belt and the coolant, and particularly to minimise variations of the belt temperature rise at various positions along the length, and more particularly across the width of the belt or band because this minimises the thermal stresses which might otherwise cause the belt or band to buckle and leave its intended precisely defined path. Increasing the heat transfer coefficient at the belt/water interface lowers the belt mean temperature for a given rate of heat transfer through the metal/belt interface. Even when the belt or band is free of an insulating coating at the surface adjacent to molten aluminium we have found it possible to achieve belt/water heat transfer coefficients sufficiently high to keep the mean belt temperature rise to modest levels which are compatible with the need to avoid thermal buckling and again we prefer our jet cooling system as the most conveniently practicable way of providing both efficient belt cooling and the differential pressure on the belt. We find that the physical dimensions and other characteristics of our jet cooling system are readily compatible with our provision of closely spaced belt path supports because with metal belts or bands of the thicknesses which are consistent with flexibility requirements on the one hand, and dent resistance requirements on the other, we are able to constrain the belts into sliding contact with supports spaced apart by distances which are only of the order 30 to 50 times the belt thickness. This constraint effectively makes the flexible belt or band extremely resistant to buckling and in combination with our efficient belt cooling system provides a moving heat exchanging membrane which follows its intended path to the precision required to achieve the prime objective of our invention.

In apparatus of this class the belts which define the broad faces of the mould or casting zone within which a strip or thin slab of metal is cast each constitute a heat exchange surface through which heat from the solidifying metal is transferred to water on the opposite side of the belt. The rate at which sheet or slab of a given thickness may be cast is dependent upon the rate at which heat can be transferred through the belt to the coolant water and it is therefore important that the arrangement for heat transfer from the cast metal to the coolant shall be efficient.

In one well known form of casting apparatus of the present type, each of the belts is supported by end pulleys for drive and tensioning purposes. The length of each belt lying in the casting zone is backed by several rows of thin, spaced discs, each row of discs being mounted on a common spindle. The back of each belt is cooled by means of a rapidly moving sheet of water, the flow of which is only slightly affected by the discs. The discs serve as virtual point supports for the back of the belt, so that substantially the whole of the rear surface of the belt is available for heat transfer from the belt to the coolant.

The flow of coolant lengthwise of the belt is normally established by projecting a sheet of water at a shallow angle of about 10° against the back of the belt by directing jets of water onto an inclined surface extending across the belt between two rows of discs and having an edge in close proximity to the surface of the belt. Each such sheet of coolant is largely removed by a scoop as its velocity decreases and is replaced by a fresh rapidly moving sheet of water, created in the same way, so that in effect the whole rear surface of the belt is covered by a rapidly moving sheet of water.

In the known apparatus, referred to above, it is usual to apply a thermal insulation coating to the surface of the belt in contact with the cast metal to prevent excessive temperature rise of the belts. This expedient is required because the unconfined sheet of water in contact with the reverse surface of the belt is unable to take up heat at the water/belt interface sufficiently rapidly.

To improve the heat exchange it is necessary to increase the turbulence in the boundary layer at the belt/water interface and we find that the jet cooling system, most preferably employed in the apparatus of the present invention, is a particularly effective method of increasing such turbulence. In our preferred system, jets of water are directed at a large angle to the surface of the belt (such angle being very conveniently 90°). We have found that by projecting a sufficiently large volume of water in the form of jets directed at a large angle to the surface through an array of closely spaced orifices onto the back of the belt, heat may be removed about three times more rapidly from the belt than is the case with the conventional system with the result that it is possible to avoid excessive temperature rise of the belt without the use of a thermally insulating coating on the metal side of the belt.

Since the volume of eater applied is very large, means must be provided for collecting the water applied to each belt and with this object in view a casting apparatus of the present type is provided with a belt cooling system co-operating with those areas of the belts which define the casting zone, the belt cooling system comprising, for each belt, an enclosed casting which is maintained in substantially sealed relation with the belt at or outwardly of the periphery of the casting zone, the casing having belt-support portions which are maintained in sliding or rolling contact with the belt surface and which form a minor proportion of the area of the casing facing the belt, water channels lying between said belt-support portions and extending over a major proportion of the area of the casing, water-jet orifices being arranged in the floor of said water channels and being arranged to direct jets of water, drawn from a water supply, at a large angle onto the surface of the belt and drain passages to drain off water from said water channels to a water outlet. Preferably the inlet water is supplied to a first plenum chamber, from which it is directed onto the belt through orifices formed in the thickness of the metal, forming the floor of the water channels, a second, outlet, plenum chamber being provided outwardly of the inlet plenum chamber and being connected with the water channels by large diameter drain tubes which extend through the inlet plenum chamber. The belt-support portions of the casing are preferably arranged so that all areas of the belt directly opposite the cast metal are in direct contact with water during a major proportion of the time they are in the casting zone. Most preferably the belt supports are formed of narrow bars of anti-friction material extending transversely of the casing, the jet orifices being arranged in one or more transverse rows between adjacent bars. The jet orifices in different rows are preferably staggered in relation to each other. The interval between jet orifices in the same lateral row preferably does not exceed 1 inch and the size of and distribution of the orifices is such that when a small pressure difference, for example 4 p.s.i., is maintained between the inlet plenum chamber and the outlet plenum chamber, water is applied to the surface of the belt at the rate of 50–150 gallons/sq.in./hr.

Whilst the arrangement of the apparatus above-described may be employed with the water maintained at superatmospheric pressure in the inlet plenum chamber, special advantages are obtained when the water is drawn through the system by the application of suction to the outlet plenum chamber, since this produces a differential pressure to the opposed surfaces of the belt and presses the belt against the belt-supporting bars, so that the belt is held to a closely defined path and is drawn through the apparatus in contact with such bars to maintain a closely defined, stable mould cavity or casting zone. This jet cooling system finds exceptional utility in apparatus in which the space on the water side of the belt is maintained at subatmospheric pressure, although, as already indicated, its usefulness is not confined to such systems.

Figure 2:
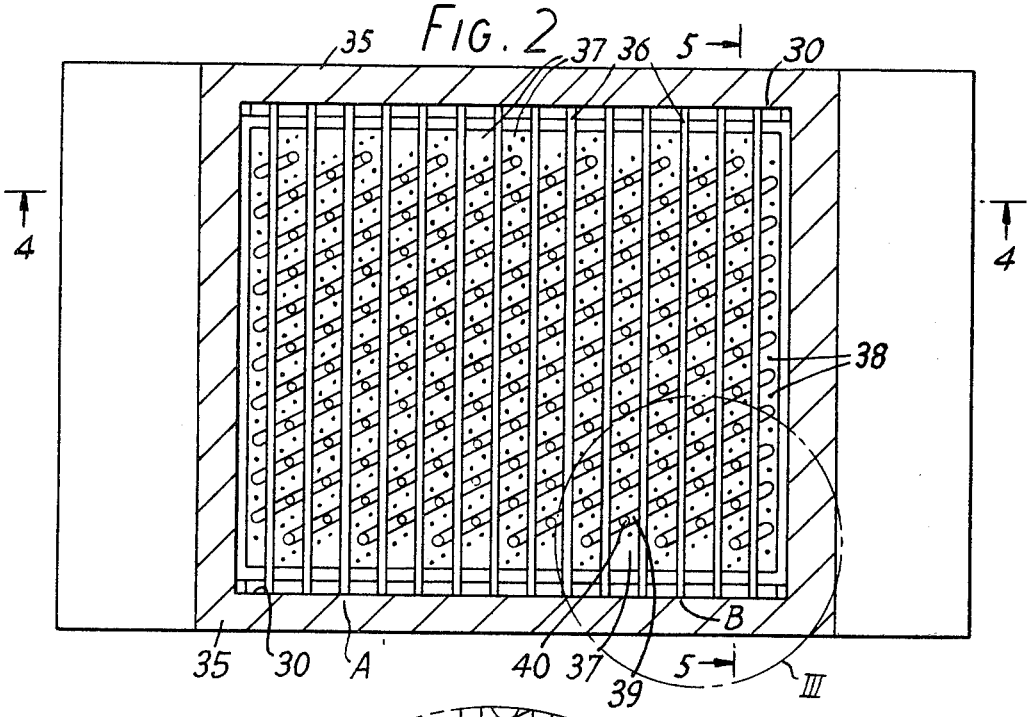
Figure 3:
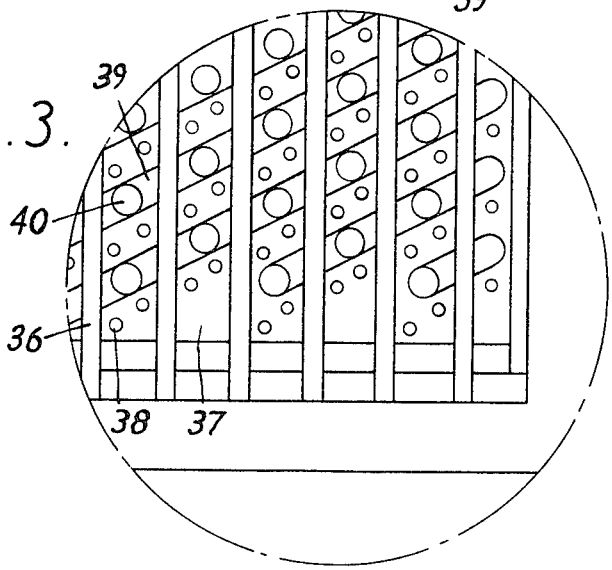
Figure 4:
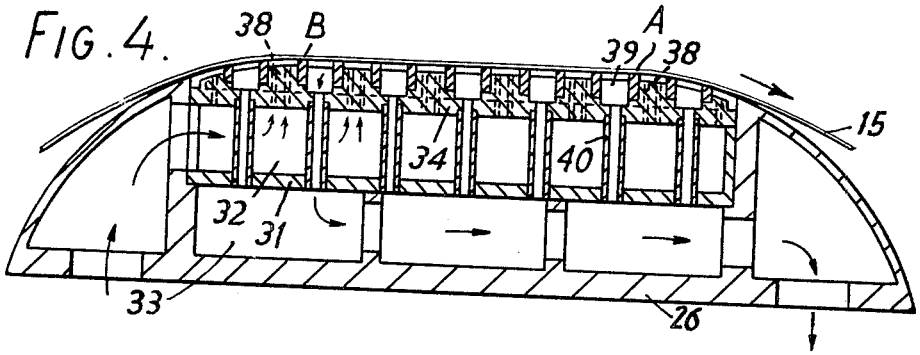
Figure 5:
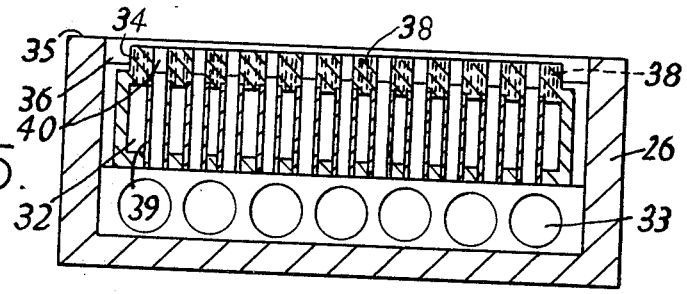
Figure 6:
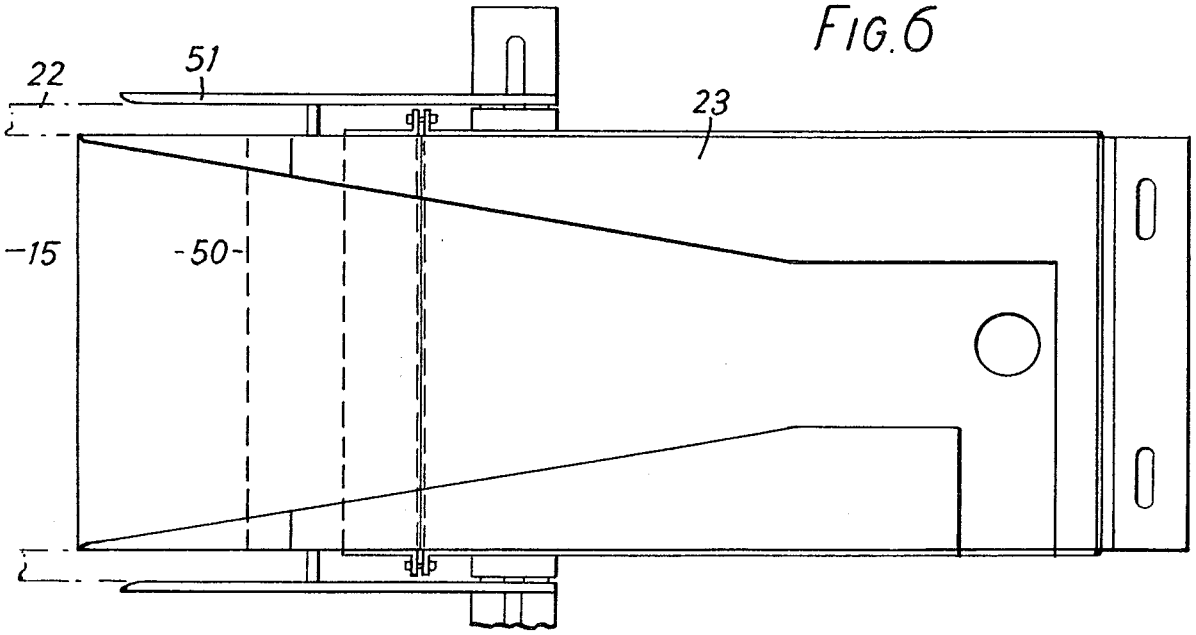
Figure 7:
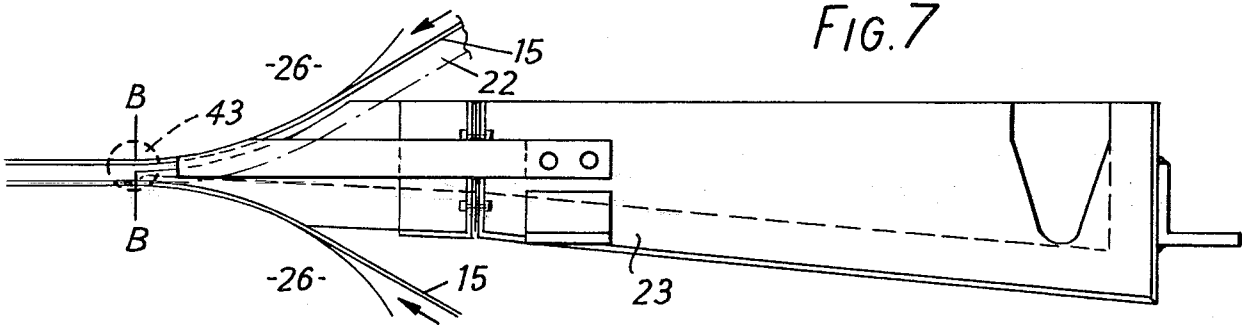
Figure 8:
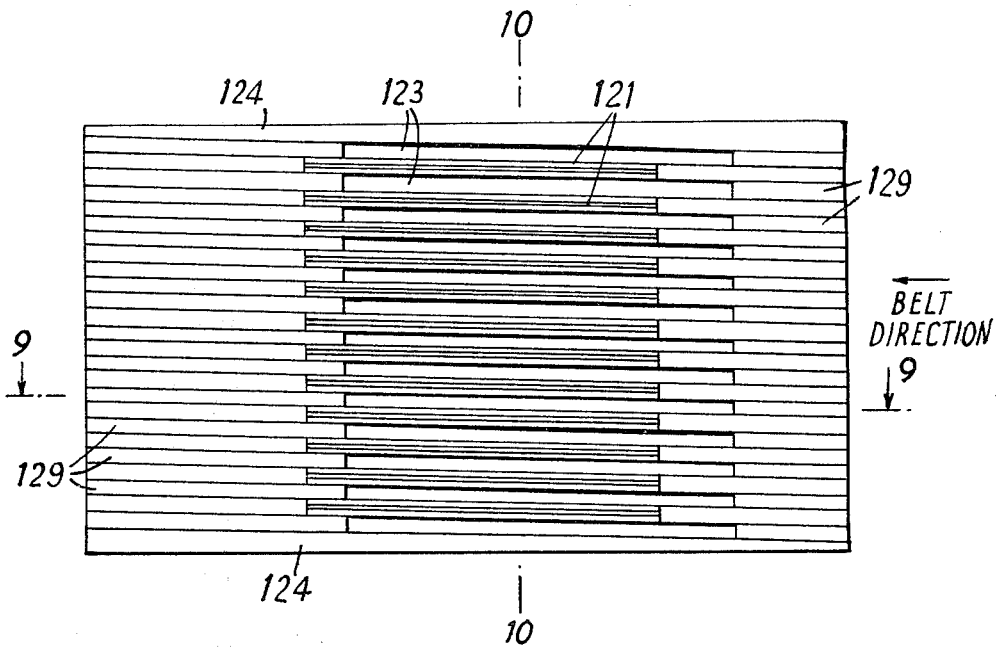
Figure 9:
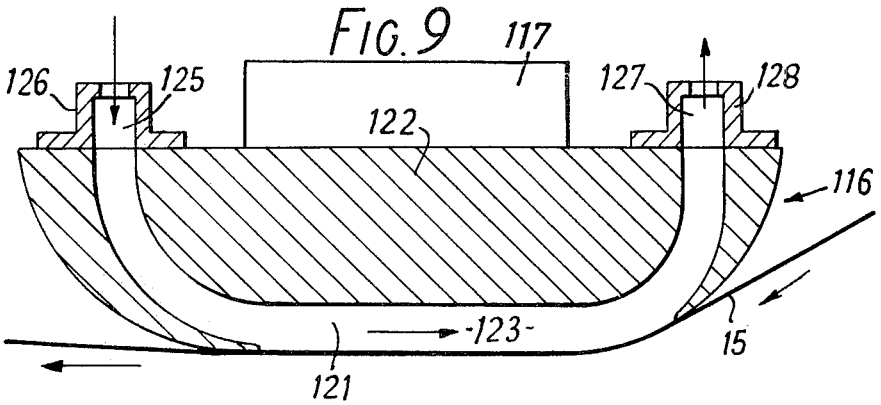
Figure 10:
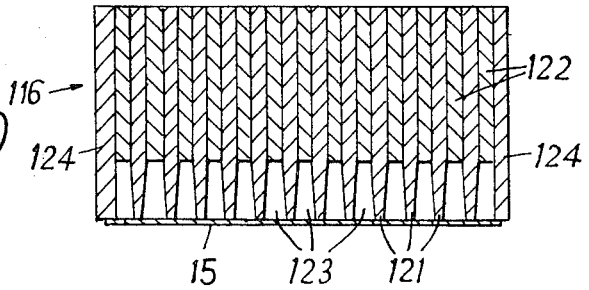

Referring now to the accompanying drawings:

FIG. 1 is a diagrammatic side view of one form of casting apparatus in accordance with the invention, FIG. 2 is a plan view of one form of arrangement for supporting the belts by differential pressure and applying coolant, FIG. 3 is a plan view of the encircled portion of FIG. 2 on a larger scale, FIG. 4 is a section of FIG. 2 on line 4—4, FIG. 5 is a section of FIG. 2 on line 5—5, FIG. 6 is a part plan view of the launder, FIG. 7 is a side view of the launder in operative position, FIG. 8 is an underneath plan view of a magnetic belt support, FIG. 9 is a section on line 9—9 of FIG. 8, and FIG. 10 is a section on line 10—10 of FIG. 8 with the casting belt added.

The apparatus illustrated in FIG. 1 comprises a fabricated support frame 1, on which is mounted upper and lower casting belt drive pulleys 2. A variable speed drive motor 3 drives a shaft 4 through chain 5 and sprocket 6. Drive is taken from shaft 4 to the lower casting belt drive pulley 2 via sprockets 7 and 8 and drive chain 9. Drive is taken from the lower casting belt drive pulley 2 to the upper pulley 2 by chain 11 which passes round upper and lower sprockets 12 and idlers 14, one of which is carried on a pivoted arm 14' for tensioning chain 11. The casting belts 15 respectively pass around their drive pulleys 2 and tensioning pulleys 16, which are rotatably mounted in slides 17, guided in slide frames 18, which are pivotally connected by pivots 19 to main frame 1 and to which a predetermined casting belt tensioning force may be applied by means of pneumatic cylinders 20. The slides 17 are longitudinally movable in the frames 18 by means of adjusters 21 for the purpose of tracking the casting belts.

The upper belt 15 carries a pair of edge dams 22, which are in the form of belts of resilient heat resisting and thermally insulating material. Such edge dams are slightly compressible so as to provide a satisfactory seal in the casting zone when it is arranged to taper longitudinally as explained above. One form of material suitable for such edge dams is in the form of a white metal or rubber core which is wrapped with a woven asbestos cloth and is supplied for use as steam gasket. The arrangement of the edge dams 22 in relation to the launder 23 is shown in FIGS. 6 and 7 and will be described in greater detail below. The arrangement for support and cooling of the casting belts 15 in the casting zone is illustrated in FIGS. 2 to 5. The belts 15 are cooled by water applied to them by means of the coolant casings 26, which will be described below. Water is drawn into the casings 26 through supply conduits 27 by means of suction pumps (not shown) connected into outlet conduits 29 so as to maintain reduced pressure on the water side of the belts.

The casing 26 is formed as a rigid, enclosed structure having a window 30 in its top surface (considering the casing as supporting the lower belt in FIG. 1). The casing has a horizontal partition 31, which divides an inlet plenum chamber 32 from an outlet plenum chamber 33. Water is supplied to plenum chamber 32 through supply conduit 27 and sucked out from plenum chamber 33 through the outlet conduit 29 by the suction pump.

The plenum chamber 32 is bounded by a thick upper partition 34, the outer surface of which is slightly recessed in relation to the surface 35 of the casing surrounding the window 30. The shaded portion of the surface 35 (FIG. 2) is coated with an anti-friction material. Narrow belt-support bars 36 extend across the full width of the window 30 and the upper surface of these bars are ground so as to be level with the adjacent area of the surface 35. Between the points A and B the surface 35 and the upper surface of the bars 36 are ground to form a flat surface, preferably with an accuracy of the order of $2 \times 10^{-4}$ inches in the longitudinal direction. The casting zone extends only between the points A and B.

Shallow water channels 37 extend between the support bars 36, the outer surface of the partition 34 and the overlying belt 15. Closely spaced jet orifices lead from the inlet plenum chamber 32 into the floor of the channels 37 and are arranged to direct jets of water substantially perpendicularly onto the surface of the belt 15. Relatively deep water collection channels 39 extend transversely to the length of channels 37 and are connected by tubes 40 with outlet plenum chamber 33.

As will be seen, in the illustrated apparatus there are two rows of relatively staggered jet orifices 38 between each pair of belt support bars 36. The longitudinal spacing between the bars 36 is about ¾ inch and it will be seen that the spacing between adjacent orifices 38 in the same row is similar. The diameter of the individual orifices 38 is about 3/16 inch.

When a pressure difference of the order of 4 p.s.i. is maintained between plenum chambers 32 and 33, it is found that water is applied to the back of the belt at a rate of approximately 60 gallons/sq.in./hr. and, in the casting of aluminium slab, this leads to a heat transfer of about 2200 BThU/sq.in./hr. Even when the spacing of the jets is decreased and the rate of coolant water application is substantially increased, the rate of heat extraction is only increased by about 10–20 percent.

The apparatus is designed so that even with the designed reduced pressure conditions in the rear side of the belt, there shall be substantially no sag of the belts between adjacent supports, so that the belt is not drawn out of heat exchange contact with the solidifying metal in the casting zone. In order to achieve this condition the spacing between the antifriction support bars 36 is preferably limited to not more than 50 times, preferably 20–50 times, the thickness of the steel belt 15, which is itself of a thickness of 0.020 to 0.060 inch.

The above described cooling system is effective to maintain the thermal gradient in the belt at a value of about 30°C. In that case it is calculated that a differential pressure of about 2 p.s.i. is required to maintain the upper belt 15 in contact with the bars 36 across the full width of the belt. However it is preferred to arrange that the outlet plenum chamber 33 be maintained at a pressure of at least 4 p.s.i. below atmospheric pressure to provide an adequate safety factor.

In FIG. 1 the spacing between the belts 15 at the entrance to the casting zone is coarsely controlled by means of packing placed as spacers at the casing support and further finely controlled by means of adjustment screws acting on tie bars 41 so as to spring the frame so that check plates 42 may be raised and lowered. The upper casing 26 is mounted in trunnions 43, the axis of which is co-incident with the point B of the casing, between the check plates, so that the taper of the mould cavity between the belts 15 may be varied by angular movement of the upper casing 26 in its trunnion bearings 43 by means of lever arm 44, which is pressed downwardly by means of pneumatic cylinder 45 to bring a stop plate 46 into contact with an adjustable abutment 47. An upper abutment 48 is provided as a safety stop. It will be appreciated that one of the advantages of this arrangement is that if the abutment 47 is set to provide excessive taper of the mould space the solidified metal at the outgoing end of the mould space will tilt the casing 26 upwardly against the resilient loading of the cylinder 46. The abutment 47 can then be reset to provide optimum surface properties for the strip issuing from the mould space.

The launder 23 (FIG. 6) is provided with a nose portion 50 which is arranged, in its operative position, to extend into the space between the belts as far as point B on the upper and lower coolant casings 26. Side dam guides 51 are secured to the side of the launder 23 and possess slight resilience so as to press the incoming side dam 22 (FIG. 7) against the side of the launder nose portion 50 thus forming a seal at the entrance to the casting zone, so that an appropriate feeding head or pool of metal may be maintained within the launder 23 during the casting operation.

Whilst as already stated the coolant application system illustrated in FIGS. 2 to 5 is most preferably employed with sub-atmospheric pressure in the plenum chambers, it also provides satisfactory results when water is supplied to the plenum chamber 32 at a pressure of about 2 p.s.i. above atmospheric pressure, providing other means are used to keep the belt in contact with the support bars 36. This could be achieved by employing ferromagnetic support bars 36 or other magnetic or magnetisable supports, preferably of low friction material. It will be appreciated that this coolant application system can be employed in apparatus in which the casting zone is arranged in a vertical direction or is steeply inclined. In such case the pressure of liquid metal may be employed to assist in holding the belts in contact with the supports. When the belts are employed in a horizontal position, as shown in the apparatus of FIG. 1, it is preferred to operate with the inlet plenum chamber 32 at 0–4 p.s.i. below atmospheric pressure and a pressure difference of about 4 p.s.i. between the inlet plenum chamber 32 and the outlet plenum chamber 33 to draw jets of water through jet orifices 38.

It is possible to contemplate that only the upper belt 15 would be held in contact with the support bars 36 by differential pressure, the weight of metal on the lower belt serving to keep the lower belt in contact with the lower set of support bars. It is, however, obviously preferable to apply suction to the outlet plenum chambers of both upper and lower casings 26.

In FIGS. 8 to 10 there is illustrated apparatus which may be substituted for that of FIGS. 2 to 5 for the purpose of supporting and cooling the belts. In the casting zone defined by the mould cavity the path of the belt 15 is controlled by an array 116 of magnetic pole pieces associated with an array 117 of laminated magnets. The belts 15 are cooled by water, which may contain a water-dispersible lubricant, circulated through channels in the arrays of pole pieces 116, so that the back of the belts in the casting zone are in direct contact with the cooling water. Where the coolant water contains a lubricant it is recirculated through an associated heat exchanger (not shown). Alternatively when no lubricant is employed the coolant water may be discarded.

The magnet unit 117 may be a conventional magnetic chuck, built up from strip-like permanent magnets, separated by brass spacers.

The array 116 of pole pieces is similarly constructed and comprise steel plates 121, separated by aluminium spacers 122. The projecting ends or edges of the plates 121 are tapered as shown in FIG. 10 and there is thus defined a series of channels 123 for the passage of coolant in contact with the back of the belt 15. The plates 121 and 122 are preferably ¼ inch thick, the plates 121 tapering to ⅛ inch at their edge. The channels 123 are arranged to be about 1 inch deep.

At each side of the array 116 are provided side plates 124, which taper longitudinally, as shown in FIG. 8, so that the pole piece plates 121 are arranged at a slight angle of inclination to the direction of the belt 15 to equalise the wear on the back of the belt as it moves over the pole pieces.

Coolant water, which is employed contra-flow to the direction of belt travel, enters via a plenum chamber 125 formed in a box 126 and exits through plenum chamber 127 in a box 128.

At the water inlet end the pole pieces 116 have a curved external profile and the waterway leading from plenum chamber 125 has a correspondingly shaped internal profile to direct the coolant water onto the inner surface of the belt. The pole pieces and waterway at the water outlet end have a similar external and internal profile, save that spacers 122 are arranged so that the belt is water-cooled over part of the curved profile at the belt (and molten metal) entry end. This ensures that the belt is fully cooled immediately prior to contact with the molten metal and avoids the belt distortion which could otherwise occur should the molten metal contact the belt prior to application of the cooling water.

In one arrangement the magnet unit 117 was a commercially available Walker-Hagon Limited Model No. 20 magnetic chuck, providing an average magnetic flux density of 120 gauss at the contact of each plate 121 with the belt 15.

It has been found that with this arrangement a pressure of about 3 lbs/sq. inch may be retained behind the belt without significant leakage. With a pressure drop of 3 lbs/sq. inch it is found possible to maintain water flow along the channels 123 at a rate sufficient to maintain the temperature rise of the belt within about 80°C. over the temperature of the coolant water. To equalise the temperature across the belt, and hence minimise distortion, hot water is preferably supplied to those channels 123, opposite the cold, outer band of the belt, i.e. outwardly of the edge dams 22. The temperature of the water is arranged to be similar to that of the belt in contact with metal and will generally be in the range 70° – 90°C. Thus those areas of the belt which are not heated by contact with the cast strip are, instead, heated by the circulating hot water. Suitable design of the inlet and outlet plenum chambers allows the number of cold water channels to be varied to accommodate different widths of cast strip. The length of the casting zone between the belts in the illustrated construction is about 9 inches (22.5 cms) and this will allow production of strip at rates of about 30 ft./minute (9 meters/minute) at 0.1 inch thickness (9 meters/minute at 2.5 mms thickness) and 10 ft./minute at 0.3 inch thickness (3 meters/minute at 7.5 mms thickness). At these rates solidification takes place within about the first 6 inches of the casting zone.

With this arrangement it is found possible to draw the belt over the surface of the pole pieces with a pull of about 10 lbs/inch width of the array of pole pieces 116 and this may be reduced by the use of a suitable lubricant dispersed or dissolved in the coolant water. Lubricant carried over on the surface of the belt helps to lubricate it and reduce friction as it is drawn over the curved outer surfaces of the plenum chamber boxes 126 and 128 at the ends of the casting zone.

It will be appreciated that this coolant application and support system may be altered or modified in various ways. Thus the magnetic pole pieces and water channels may be arranged transversely instead of longitudinally of the belt.

In some instances, where the desired rate of heat extraction through the belt is low, the steel plates 121 are not tapered and the edges of the aluminium plates 122 are level with the edges of the plates 121. Heat may then be removed by the provision of water channels within the assembly, such channels being formed by means of grooves in the side faces of the plates 121 and 122. The edge portions of the aluminium plates thus act as conductors for the transfer of heat from the belt to the coolant passing in the internally defined passages.

It will be understood that the relative inclination of upper and lower magnetic units 117 and pole piece arrays 116 may be controlled in the same manner as indicated in FIG. 1 by means of air cylinder 45 and its associated stops and lever arms.

The apparatus illustrated in FIGS. 1 to 7 has been utilised most successfully to cast aluminium and aluminium alloy strip having excellent surface qualities.

Where the material cast is a commercial quality aluminium which solidifies within a very narrow temperature range it was found possible in the apparatus of FIG. 1, in which the length of the casting zone between the points A and B is about 9 inches to cast the material at a rate of 9 ft./minute at a thickness of 0.475 inches and arranging that the separation of the belts was about 0.025 inches less at the outgoing end of the casting zone than at the ingoing end.

Where the abutment stop 47 was set so as to maintain the belts 15 strictly parallel through the casting zone it was still found possible to obtain material of good surface quality i.e. free from exudation, when the material was cast at a rate of 5 ft./minute. If higher speeds were attempted the strip was found to be "hot short" and started to break up as it left the apparatus. This demonstrates that the solidifying strip was contracting away from the upper belt before reaching point A with consequent reduction in the rate of heat extraction from the strip and indicates the special advantage obtainable from the facility for adjusting the relative inclination of belts which themselves follow closely controlled linear paths.

Where the material cast was an aluminium alloy having different components which solidify at temperatures within a wide range of, for example, 110°C, it was found that alloy strip of a thickness of 0.475 inches could be cast at a rate of 7½ ft./minute without appearance of surface exudates when the gap between the belts was about 0.020 inches less at the outgoing end than at the ingoing end.

Examples of alloys which have been cast satisfactorily at 0.475 inch thickness:

| | | |
|---|---|---|
| (i) | Commercial purity 99.6% aluminium<br>Casting speed 9 ft./min. | Freezing range<br>20°C. |
| (ii) | Al — 5% Cu alloy<br>Casting speed 7½ ft./min. | Freezing range<br>110°C. |
| (iii) | Al — 4% Mg alloy<br>Casting speed 7½ ft./min. | Freezing range<br>100°C. |
| (iv) | Al—Cu—Zn—Mg—Mn alloy (AA3105)<br>Casting speed 8 ft./min. | Freezing range<br>40°C. |

In all cases the cast strip shape was good and no indication of surface exudation was visible at a magnification of 200 times. The cast strip had a uniformly very fine grain structure.

It will be understood that the precise machining or equivalent shaping of the belt-facing surfaces of the support elements to lie in a common plane for each belt can be effected to provide any minor or localized contour of the common area that may be wanted, e.g. within the general connotation of a plane. For example, it may be desirable to have a very slight longitudinal curvature (such as with a radius of 50 meters) of the belt-guiding surfaces, e.g. convex toward the mold space so that such surfaces in effect curve apart, from output to input, in addition to or instead of a small straight taper. Other contour variation for the profile-defining surfaces may include a very slight relieving (widening of mold space) close to the longitudinal edges of the belt paths, at and approaching the output end and merging to zero such departure of contour at the input end and throughout nearly all of the surface area between the edge regions. As will be appreciated, these very slight departures from absolute plane surfaces can be deemed the equivalent (being indeed substantially plane) especially in the light of a basic feature of the invention in providing a multiplicity of closely spaced support elements having faces very precisely shaped to form a surface of selected shape, against which the belt is urged; the major aspect being that the belt is precisely guided by the precision of the shaped surface.

We claim:

1. An apparatus for the continuous casting of metal in strip form comprising a pair of movable heat conducting metal belts, defining therebetween a mould space, means for applying coolant to the reverse faces of said belts adjacent said mould space, said apparatus including at opposite faces of said mould space a plurality of belt supports at closely spaced positions lying in a surface defining a path for the adjacent belt, and means effective independently of head of metal in the mould space for applying to each of said belts during transit through said mould space an outwardly directed force in a direction perpendicular to the path of that part of the belt to hold the same in a closely defined path in contact with said belt supports, including means for applying a subatmospheric pressure to the rear surface of at least one of said belts during its transit through said mould space, said apparatus further comprising at said casting zone a system for the application of coolant and differential pressure to the reverse face of at least one of said belts, said system comprising a rigid casing, a belt contacting surface on the outside of said casing, an opening in said casing lying within and surrounded by said surface, an inlet plenum chamber separated from said opening by a first partition, a water inlet passage to said plenum chamber, a plurality of closely spaced jet orifices formed in said first partition, the axes of said jet orifices being at a large angle to the belt in contact with said belt contacting surface, an outlet plenum chamber separated from the inlet plenum chamber by a second partition, closely arranged belt support members being arranged in said opening and supported by said first partition, said support members being level with the surrounding belt contacting surface of the casing, recessed water passages lying between said support members, the said jet orifices opening into said water passages for directing individual closely spaced jets of water onto the reverse surface of the belt in the casting zone, drain passages leading from said water passages to said outlet plenum chamber whereby the application of suction to the outlet plenum chamber draws water into said inlet plenum chamber and directs closely spaced individual water jets onto the reverse surface of the belt and simultaneously creates reduced pressure conditions in said water passages between said belt support members to draw the belt against said support members to define the path of the belt through the casting zone.

2. An apparatus according to claim 1 in which said belt support members comprise a series of transversely arranged bars, the spacing between adjacent bars being about 20 – 50 times the thickness of the associated casting belt.

3. An apparatus according to claim 1 in which said casing is mounted to pivot about a transverse axis to permit the plane of the belt in contact therewith to be adjusted in relation to the plane of the other belt in the casting zone.

4. An apparatus according to claim 3 in which a pair of edge dams are provided at the side edges of the casting zone, said side dams being connected for transport with one of said belts and comprising an endless band of a resilient, thermally insulating and heat resistant material.

5. An apparatus for the continuous casting of metal in strip form comprising a pair of movable heat conducting metal belts, defining therebetween a mould space, means for applying coolant to the reverse faces of said belts adjacent said mould space, said apparatus including at opposite faces of said mould space a plurality of belt supports at closely spaced positions lying in a surface defining a path for the adjacent belt, and means effective independently of head of metal in the mould space for applying to each of said belts during transit through said mould space an outwardly directed force in a direction perpendicular to the path of that part of the belt to hold the same in a closely defined path in contact with said belt supports, further comprising, at said casting zone for application of coolant and force in a direction perpendicular to its path to at least one of said belts, magnet means, an array of closely spaced ferromagnetic pole pieces associated with said magnet means, said array of closely spaced pole pieces presenting a plane surface and forming a plurality of belt supports for said belt, said magnet means and pole pieces being constructed and arranged to pull the belt against said pole pieces, and water cooling passages associated with said array of pole pieces for withdrawal of heat from said belt.

6. An apparatus according to claim 5 in which said array of pole pieces comprises a series of ferromagnetic plates separated by non-magnetic metal plates, said ferromagnetic plates projecting beyond said non-magnetic plates towards the associated belt to provide water passages defined between the reverse surface of the belt and a pair of adjacent ferromagnetic plates.

7. An apparatus according to claim 6 in which said array is mounted to pivot about a transverse axis to permit the plane of the belt in contact with said pole pieces to be adjusted in relation to the other belt in the casting zone.

8. In an apparatus for the continuous casting of metal in strip form comprising a pair of movable, heat-conducting metal belts, defining therebetween a mould space, the improvement which comprises providing means including space-enclosing casing means abutting the reverse surface of each belt, for forming an essentially water-filled cooling space at said reverse surface of each belt at the mould space, a series of closely spaced jet orifices directed substantially perpendicular to the reverse surface of each belt travelling through the casting zone defined by the mould space, for projecting water into said water-filled cooling space and towards the belt, the spacing between adjacent jet orifices being not more than 1 inch and said orifices being arranged to maintain coverage of the major part of the reverse surface of said belt with water by means of jets of water delivered onto said belt through said orifices, and water-withdrawing means comprising drain means for removing water from said cooling spaces, including a series of drain passages closely adjacent, respectively, to each of said jet orifices.

9. An apparatus according to claim 8 in which all of the jet orifices directed at one belt are apertures formed in the wall of a supply plenum chamber forming a boundary of said water-filled cooling space, the outlet end of the orifices being held in spaced relation to said belt by associated belt guiding means.

10. An apparatus for the continuous casting of metal in strip form comprising a pair of movable heat conducting metal belts, defining therebetween a mould space extending from a first locality where molten metal enters between the belts to a second locality where solidified metal strip departs from the belts, means for applying coolant in heat-conducting relation to the reverse faces of said belts adjacent said mould space, and belt guiding means distributed over the reverse face of each belt substantially throughout the entire extent of said mould space between said localities and disposed to determine a predetermined size of said mould space between the belts, each said belt guiding means comprising a multiplicity of closely spaced, beltsupporting elements lying in a surface defining a path for the adjacent belt, said apparatus being constructed and arranged so that each belt, during transit through the mould space, is forced in a direction outwardly of the mould space against the corresponding guiding means and is thereby caused to lie in the surface defined by said last-mentioned guiding means substantially throughout said mould space, said construction and arrangement of the apparatus comprising means effective independently of head of metal in the mould space for applying force on at least one of the belts in said outward direction to hold said last-mentioned belt against its guiding means, and said force-applying means comprising means, including ferromagnetic composition of said last-mentioned belt and of said last-mentioned guiding means, for magnetically drawing said last-mentioned belt against said last-mentioned guiding means.

11. Apparatus as defined in claim 10, which further comprises structures respectively corresponding to the belts for carrying the belt guiding means, means mounting said structures to provide longitudinal taper of said belts toward each other in the direction of metal travel from said first locality of said second locality, said mounting means including provision for varying the mutual inclination of the belts to vary the taper, and means for loading one supporting structure toward the other into a selected position of taper, said loading means being resilient to permit increase of spacing between the belts when required by solidified metal at the said second locality of the mold space.

12. An apparatus for the continuous casting of metal in strip form comprising a pair of movable heat-conducting metal belts, defining therebetween a mold space, a plurality of belt-guiding means distributed adjacent to the reverse faces of said belts over the extent of said mold space, for defining the paths of the belts, and belt cooling means which comprise space-enclosing casing means at the reverse face of each belt for applying coolant water to said reverse face at said mold space, and associated means, including coolant water supply and withdrawal means, said casing means being constructed and arranged to provide an essentially water-filled cooling space along said reverse face, for maintaining a selected pressure in each casing means at said reverse face, to apply a differential pressure to each belt such that the pressure at the reverse face is lower than the pressure in the mold space, for urging each belt toward its guiding means, and said associated means for applying a differential pressure to each belt being constructed and arranged for maintaining such differential pressure sufficient to urge each belt against its guiding means before introduction of molten metal into the mold space.

13. An apparatus for the continuous casting of metal in strip form comprising a pair of movable heat conducting metal belts, defining therebetween a mold space, a plurality of belt guiding means distributed adjacent to the reverse faces of said belts over the extent of said mold space, for defining the paths of the belts, and belt cooling means which comprises space-enclosing casing means at the reverse face of each belt for forming an essentially water-filled cooling space at said reverse face over the extent of said mold space, and associated water-circulating means for supply and withdrawal of coolant water in each said casing means, including means for maintaining subatmospheric pressure in the casing means at the reverse face of each belt, to hold such belt in the path defined by the guiding means.

14. Apparatus as defined in claim 13 in which the water-circulating means includes means for directing the water in a multiplicity of jets substantially perpendicularly against the reverse face of each belt.

15. An apparatus for the continuous casting of metal in strip form comprising a pair of movable heat conducting metal belts, defining therebetween a mold space, a plurality of belt guiding elements distributed adjacent to the reverse faces of said belts over the extent of said mold space, the elements at each said reverse face being narrow, closely spaced and having belt-abutting plane faces fixed to lie in a common surface for defining the path of the corresponding belt, and belt cooling and retaining means which comprises space-enclosing casing means disposed at the reverse face of each belt at said mold space to receive coolant water, including structure directing such water against the belt and providing withdrawal of water, and including means for maintaining a subatmospheric pressure in each said casing over the enclosed reverse belt face to hold the belt against the corresponding guiding elements.

16. Apparatus as defined in claim 15 in which said water-directing structure comprises, in each casing means, a multiplicity of closely spaced jet orifices between the guiding elements for projecting water substantially perpendicularly toward the reverse face of the belt.

17. An apparatus for the continuous casting of metals in strip form comprising a pair of movable heat-conducting metal belts, defining therebetween a mold space, means for applying coolant to the reverse faces of said belts adjacent said mold space, said apparatus including, at opposite faces of said mold space, structures respectively associated with the reverse faces of the belts for supporting the moving belts in desired opposing positions, means at one end of the mold space for introducing molten metal therein for delivery of solidified strip at the other end, and means mounting said structures to provide taper of said belts toward each other from said one end, including provision for movement of one structure toward and away from the other to alter said taper and provision for urging the structures together in a direction of increase of said taper for keeping the belts in contact with the metal in the mold space, said coolant-applying means comprising space-enclosing casing means at the reverse face of each belt throughout said mold space, wherein coolant water is distrubuted on said reverse face, including means for maintaining subatmospheric pressure in each casing means to urge each belt toward its supporting structure, for maintaining the belts in said desired positions.

18. An apparatus for the continuous casting of metal in strip form comprising a pair of movable heat conducting metal belts of predetermined thickness, defining therebetween a mold space, a plurality of belt guiding elements distributed adjacent to the reverse faces of said belts over the extent of said mold space, the elements at each said reverse face being narrow, closely spaced and having belt-abutting, narrow, plane faces fixed to lie in a common, flat surface for defining the path of the corresponding belt, cooling means comprising means for circulating coolant water on the reverse face of each belt in the spaces between the elements, the narrowness of the elements and the spaces between them being such that water circulating means covers, collectively in the spaces, the major part of the reverse surface of each belt with water, and the spaces between the elements being sufficiently close, not more than fifty times the thickness of each belt, so that there is substantially no sag of the belt between adjacent elements.

19. Apparatus as defined in claim 18 in which the cooling means comprises space-enclosing casing means over the reverse face of each belt at the mold space, wherein said coolant water is applied, including means for maintaining subatmospheric pressure in each casing means to urge each belt toward its corresponding guiding elements to keep the belt in its defined path.

20. Apparatus as defined in claim 18 wherein the metal belts have a thickness in the range of 0.02 to 0.06 inch, the water circulating means comprises a multiplicity of jet orifices distributed throughout the spaces between the guiding elements of each belt for directing coolant water substantially perpendicularly toward the reverse face of the belt, adjacent cooling orifices being spaced no more than one inch apart over the extent of the mold space, and the guiding elements being spaced apart by distances in the range of 20 to 50 times the belt thickness.

21. In apparatus for the continuous casting of metal in strip form comprising a pair of movable heat-conducting metal belts, defining therebetween a mold space, said apparatus including at opposite sides of said mold space a plurality of belt supports defining the path of the belt in contact therewith, said apparatus being constructed and arranged so that each belt is forced outwardly of the mold space against its belt supports, said construction and arrangement of the apparatus comprising means for applying subatmospheric pressure to the reverse face of at least one of said belts at said mold space to hold said belt in contact with its said belt supports, and means for applying coolant to the reverse faces of said belts at said mold space.

22. An apparatus for the continuous casting of metal in strip form comprising a pair of movable heat-conducting metal belts, defining therebetween a mold space, said apparatus including at opposite sides of said mold space a plurality of belt supports defining the path of the belt in contact therewith, said apparatus being constructed and arranged so that each belt is forced outwardly of the mold space against its belt supports, said construction and arrangement of the apparatus comprising means independent of metal in the mold space for establishing a pressure difference on opposite faces of at least one of said belts at said mold space such that the pressure at the reverse face is lower than the pressure in the mold space, to hold said belt in contact with its said belt supports, and means for applying coolant to the reverse faces of said belts at said mold space.

23. Apparatus as defined in claim 22, which further comprises structures respectively corresponding to the belts for carrying the belt supports, means mounting said structures to provide longitudinal taper of said belts toward each other in the direction of metal travel from one end of the mold space which is the entrance for metal to be cast, said mounting means including provision for varying the mutual inclination of the belts to vary the taper, and means for loading one supporting structure toward the other into a selected position of taper, said loading means being resilient to permit increase of spacing between the belts when required by solidified metal at the outgoing end of the mold space.

24. In apparatus for the continuous casting of metal in strip form between a pair of movable heat-conducting cooled metal surfaces following defined paths so as to define therebetween a mold space wherein the metal is cast, against said surfaces, to solidify into the form of strip moving with the surfaces, the combination of a movable heat conducting metal belt providing one of said surfaces facing the mold space, a plurality of closely spaced belt guiding means distributed adjacent to the reverse face of said belt and having belt-facing portions lying in a common surface for defining the path of the belt, and means, comprising space-enclosing casing means at the reverse face of the belt and associated means for supply and withdrawal of liquid coolant, arranged to provide an essentially liquid-filled cooling space along said reverse face and to provide a selected pressure in said space, for establishing a pressure difference on opposite faces of the belt such that the pressure at the reverse face of the belt is lower than the pressure in the mold space, to force the belt outwardly of the mold space for holding it in its desired path conforming with said common surface of the guiding means, said means for establishing a pressure difference on opposite faces of the belt being constructed and arranged for maintaining such pressure difference sufficient to urge the belt against the guiding means before introduction of molten metal into the mold space.

25. Apparatus according to claim 24 in which the coolant supply means comprises a multiplicity of closely spaced jet orifices directed to project liquid coolant into said cooling space substantially perpendicular to the reverse face of the belt, to provide coolant jets toward said reverse face.

* * * * *